US010001101B2

(12) United States Patent
Sugiyama et al.

(10) Patent No.: US 10,001,101 B2
(45) Date of Patent: Jun. 19, 2018

(54) FUEL INJECTION VALVE

(71) Applicants: Natsuki Sugiyama, Nissin (JP); Mitsutaka Yoshida, Nagakute (JP); Akio Satou, Toyota (JP); Masahiko Asano, Toyota (JP); Yasuo Kinoshita, Nagakute (JP); Masao Nakayama, Nagoya (JP); Kenji Kidera, Toyota (JP); Masaru Setodoi, Nissin (JP); Hirokazu Ito, Susono (JP); Hiroyuki Sakai, Gotenba (JP)

(72) Inventors: Natsuki Sugiyama, Nissin (JP); Mitsutaka Yoshida, Nagakute (JP); Akio Satou, Toyota (JP); Masahiko Asano, Toyota (JP); Yasuo Kinoshita, Nagakute (JP); Masao Nakayama, Nagoya (JP); Kenji Kidera, Toyota (JP); Masaru Setodoi, Nissin (JP); Hirokazu Ito, Susono (JP); Hiroyuki Sakai, Gotenba (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 336 days.

(21) Appl. No.: 14/780,671

(22) PCT Filed: Mar. 28, 2014

(86) PCT No.: PCT/IB2014/000438
§ 371 (c)(1),
(2) Date: Sep. 28, 2015

(87) PCT Pub. No.: WO2014/162187
PCT Pub. Date: Oct. 9, 2014

(65) Prior Publication Data
US 2016/0047346 A1 Feb. 18, 2016

(30) Foreign Application Priority Data
Apr. 2, 2013 (JP) ..... 2013-076982

(51) Int. Cl.
*F02M 61/18* (2006.01)
*F02M 63/00* (2006.01)

(52) U.S. Cl.
CPC ..... *F02M 61/1833* (2013.01); *F02M 61/184* (2013.01); *F02M 61/1846* (2013.01); *F02M 61/1853* (2013.01); *F02M 63/008* (2013.01)

(58) Field of Classification Search
CPC .. F02M 61/18; F02M 61/1833; F02M 61/184; F02M 61/1846; F02M 61/1853
See application file for complete search history.

(56) References Cited

U.S. PATENT DOCUMENTS

2001/0017325 A1* 8/2001 Harata ..... F02M 51/0614 239/533.12
2003/0141387 A1 7/2003 Xu
(Continued)

FOREIGN PATENT DOCUMENTS

DE 102009055102 A1 7/2010
JP H08-326621 A 12/1996
(Continued)

*Primary Examiner* — Ryan A Reis
(74) *Attorney, Agent, or Firm* — Oliff PLC

(57) ABSTRACT

In a fuel injection valve having a nozzle hole plate wherein a nozzle hole is formed, the nozzle hole is formed with a flow path cross-section having an oval shape that has long axes and short axes, and the nozzle hole is formed having a tapered shape in which a flow path sectional area becomes larger from an entry-side open end portion toward an exit-side open end portion. The nozzle hole is formed such that a second angle that is an intersecting angle of opposing nozzle hole inner wall surface portions in an oblique section along the short axes of the entry-side open end portion and
(Continued)

the exit-side open end portion, is greater than a first angle that is an intersecting angle of opposing nozzle hole inner wall surface portions in a longitudinal section along the long axes of the entry-side open end portion and the exit-side open end portion.

16 Claims, 7 Drawing Sheets

(56) References Cited

U.S. PATENT DOCUMENTS

| | | | | |
|---|---|---|---|---|
| 2009/0065609 | A1* | 3/2009 | Suzuki | F02M 61/1813 239/265.27 |
| 2010/0282872 | A1* | 11/2010 | Krause | F02M 51/0671 239/533.12 |
| 2012/0104121 | A1* | 5/2012 | Watanabe | F02M 61/1806 239/569 |
| 2014/0191065 | A1* | 7/2014 | Suzuki | F02M 61/1833 239/584 |

FOREIGN PATENT DOCUMENTS

| | | | | |
|---|---|---|---|---|
| JP | 2001-317431 | A | | 11/2001 |
| JP | 2002-221128 | A | | 8/2002 |
| JP | 2002221128 | A | * | 8/2002 |
| JP | 2004-169572 | A | | 6/2004 |
| JP | 2005-207274 | A | | 8/2005 |
| JP | 2007-315276 | A | | 12/2007 |
| JP | 2010-508468 | A | | 3/2010 |
| JP | 2013-087757 | A | | 5/2013 |

* cited by examiner

FUEL INJECTION VALVE

BACKGROUND OF THE INVENTION

1. Field of the Invention

The invention relates to a fuel injection valve.

2. Description of Related Art

Japanese Patent Application Publication No. 2002-221128 (JP 2002-221128 A), for example, describes a fuel injection valve that includes a valve body in which a valve hole is formed, a needle (hereinafter, referred to as a "valve element") provided inside the valve body so as to open and close the valve hole, and a nozzle hole plate that forms a nozzle hole that extends through the nozzle hole plate in a plate thickness direction.

The nozzle hole is formed such that a flow path sectional area becomes larger from an open end portion (an entry-side open end portion) positioned on the valve body side toward an open end portion (an exit-side open end portion) positioned on the opposite side from the valve body.

Also, the nozzle hole is formed such that the center of the exit-side open end portion is positioned farther toward an outer edge portion side of the nozzle hole plate than the center of the entry-side open end portion, in a plan view with respect to the nozzle hole plate.

However, simply forming the flow path sectional shape of the nozzle hole such that the flow path sectional area becomes larger from the entry-side open end portion toward the exit-side open end portion does not promote atomization of the fuel droplets because a fuel liquid film injected out from the nozzle hole does sufficiently spread out.

SUMMARY OF THE INVENTION

The invention thus provides a fuel injection valve capable of promoting atomization of fuel droplets by sufficiently spreading out the fuel liquid film injected out from the nozzle hole.

A first aspect of the invention relates to a fuel injection Valve that includes a valve body that includes a valve hole; a valve element provided in the valve body so as to open and close the valve hole; and a nozzle hole plate provided in the valve body so as to cover the valve hole, a nozzle hole that extends through in a plate thickness direction being formed in the nozzle hole plate. A flow path cross-section of the nozzle hole is such that an entry-side open end portion that is positioned on the valve body side is formed in an oval shape having a long axis and a short axis, in a plan view with respect to the nozzle hole plate. The nozzle hole is formed such that a second angle that is an intersecting angle of opposing nozzle hole inner wall surface portions in a cross-section along the short axis of the entry-side open end portion is greater than a first angle that is an intersecting angle of opposing nozzle hole inner wall surface portions in a cross-section along the long axis of the entry-side open end portion.

According to this aspect, fuel injected out from the nozzle hole spreads out in the direction of the short axis of the entry-side open end portion, and air from outside the valve body is able to be sucked into the nozzle hole in concert with injection of the fuel.

Thus, regarding the fuel injected out from the nozzle hole, the fuel injection valve makes the thickness of the fuel liquid film in the direction of the long axis of the entry-side open end portion thin, and sufficiently spreads the liquid fuel film in the direction of the short axis of the entry-side open end portion, so atomization of the fuel droplets is able to be effectively promoted.

In the aspect described above, the flow path cross-section of the nozzle hole may be formed in a tapered shape such that a flow path sectional area becomes larger from the entry-side open end portion positioned on the valve body side toward the exit-side open end portion positioned on an opposite side from the valve body.

According to this structure, with the fuel injection valve of the invention, the area over which the fuel that is sprayed out from the nozzle hole is diffused is expanded.

In the aspect described above, the center of the exit-side open end portion of the nozzle hole may be formed positioned farther toward an outer edge portion side of the nozzle hole plate than the center of the entry-side open end portion.

According to this structure, with the fuel injection valve of the invention, the fuel sprayed out from the nozzle hole is able to be sprayed radially outward of the valve hole.

In the aspect described above, the nozzle hole may be formed such that the center of the exit-side open end portion and the center of the entry-side open end portion do not overlap with each other in an axial view of the nozzle hole.

According to this structure, the atomized fuel is able to be sprayed in an asymmetrical area centered around the axis of the nozzle hole.

Accordingly, the fuel injection valve of the invention is able to be inhibited from interfering with fuel that is injected from an adjacent nozzle hole, so atomization of fuel droplets is able to be promoted.

In the aspect described above, the nozzle hole may be formed such that an outside angle that is an intersecting angle of an axis of the nozzle hole and the nozzle hole inner wall surface portion positioned on an outer edge portion side of the nozzle hole plate is larger than an inside angle that is an intersecting angle of the axis of the nozzle hole and the nozzle hole inner wall surface portion positioned on a center side of the nozzle hole plate, in a cross-section along the long axis of the entry-side open end portion.

According to this structure, the flow path cross-section of the exit-side open end portion of the nozzle hole is asymmetrical with respect to the short axis of the entry-side open end portion, so the curvature of the portion on the center side of the nozzle hole plate where the fuel runs down on the inner wall surface portion of the nozzle hole becomes smaller.

Therefore, with the fuel injection valve of the invention, the amount of air sucked into the nozzle hole from outside the valve body in concert with injection of the fuel is able to be increased from that of the related art. Also, with the fuel injected out from the nozzle hole, the fuel liquid film in the direction of the long axis of the entry-side open end portion is made thinner, and the fuel liquid film sufficiently spreads out in the direction of the short axis of the entry-side open end portion, so atomization of fuel droplets is able to be effectively promoted.

In the aspect described above, the nozzle hole may be formed such that the long axis of the entry-side open end portion extends toward the center of the valve hole.

According to this structure, the flow of fuel is close to the portion of the inner wall surface portion of the nozzle hole, which is positioned on the center side of the nozzle hole plate, so boundary layer peeling can be made to occur in the fuel that flows through the nozzle hole.

Thus, disturbance in the fuel that flows through the nozzle hole expands, so with fuel that is injected out from the nozzle hole, the thickness of the fuel liquid film in the direction of the long axis of the entry-side open end portion is made thinner, and the fuel liquid film sufficiently spreads out in the direction of the short axis of the exit-side open end portion, so atomization of fuel droplets is able to be effectively promoted.

In the aspect described above, the nozzle hole may be formed such that the entry-side open end portion is adjacent to an edge portion of the valve hole.

According to this structure, the fuel that flows between the inner peripheral surface portion of the valve body and the outer peripheral surface portion of the valve element is able to be led directly to the nozzle hole.

Therefore, the fuel injection valve of the invention keeps the disturbance in the fuel that has come through the valve body from attenuating easily, so atomization of the fuel droplets of the fuel injected out from the nozzle hole is able to be effectively promoted.

In the aspect described above, a recessed portion that surrounds a periphery of the valve hole may be formed in a portion of the nozzle hole plate that faces the valve body.

This structure keeps the entry-side open end portion of the nozzle hole from overlapping with the end portion of the valve body, so the machining accuracy of the nozzle hole does not have be as high.

Also, with the fuel injection valve, stagnation of fuel occurs between the recessed portion and the end portion of the valve body, and disturbance in the fuel that flows through the nozzle hole expands, so atomization of the fuel droplets of the fuel that is injected out from the nozzle hole is able to be effectively promoted.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, example embodiments of the fuel injection valve according to the invention will be described with reference to the accompanying drawings.

(First Example Embodiment)

Figure 1A:
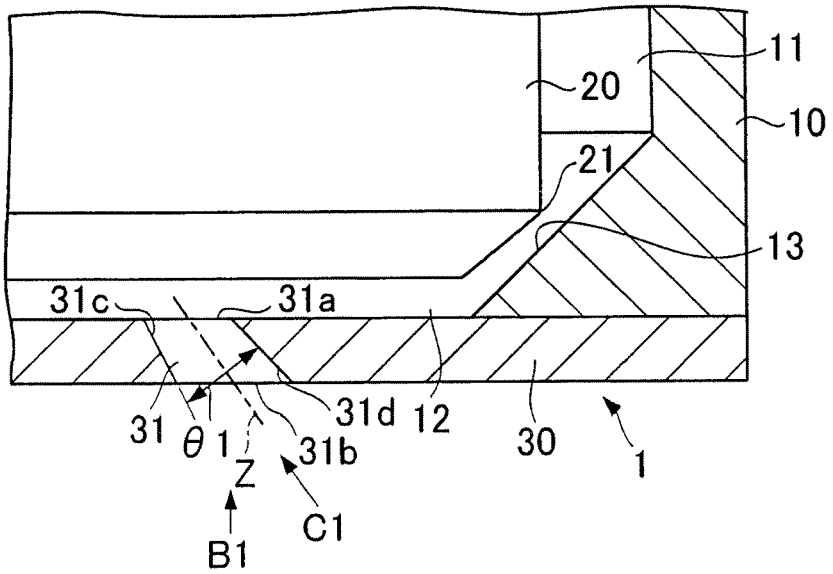
FIG. 1A is a longitudinal sectional view of a tip end portion of a fuel injection valve according to a first example embodiment of the invention.

A fuel injection valve 1 according to a first example embodiment of the invention includes a valve body 10, a valve element 20, and a nozzle hole plate 30, as shown in FIG. 1A. A plurality of nozzle holes 31 that extend through in a plate thickness direction are provided in the nozzle hole plate 30. Hereinafter, these nozzle holes 31 will be described in the singular to simplify the description.

The valve body 10 is a hollow structure, and has a fuel supply passage 11 that extends vertically, and a valve hole 12 that opens downward and is communicated with a lower end portion of the fuel supply passage 11. Fuel that has been pressurized by a pump, not shown, is delivered to the fuel supply passage 11. An inner peripheral surface portion of the valve hole 12 is formed such that an inner diameter becomes smaller in a tapered shape farther downward, and forms a valve seat 13.

The valve element 20 is a rod-like body that extends in the vertical direction and is arranged on the same axis as the valve body 10, inside the valve body 10. A lower end portion of the valve element 20 is formed such that an outer diameter becomes smaller in a tapered shape farther downward. The entire periphery where the outer diameter of this tapered portion is largest is a seal portion 21 that contacts the valve seat 13 of the valve body 10.

The valve element 20 moves in the vertical direction by a valve driving device formed by a spring and a solenoid coil and the like, not shown, so as to open and close the valve hole 12 of the valve body 10.

The spring serves to push the valve element 20 downward with respect to the valve body 10. That is, when the solenoid coil is not energized, the valve element 20 is pushed downward by the restoring force of the spring, such that the seal portion 21 contacts the valve seat 13 of the valve body 10, thereby cutting off communication between the fuel supply passage 11 and the valve hole 12.

The solenoid coil serves to lift the valve element 20 upward against the restoring force of the spring. That is, when the solenoid coil is energized, the valve element 20 is lifted (i.e., drawn) upward by magnetic attraction force, such that the seal portion 21 separates from the valve seat 13 of the valve body 10, and the fuel supply passage 11 consequently becomes communicated with the valve hole 12.

The nozzle hole plate 30 is attached by welding or the like to a lower end portion of the valve body 10 so as to cover the valve hole 12.

Figure 1B:
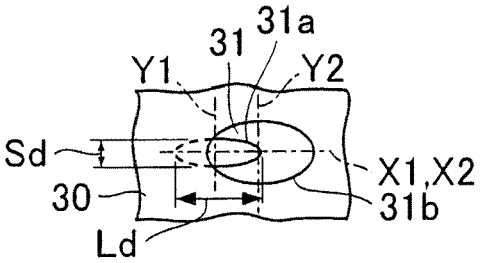
FIG. 1B is a view from direction B1 in FIG. 1A.

The nozzle hole 31 is formed with a flow path cross-section having an oval shape that has long axes X1 and X2 and short axes Y1 and Y2, in a plan view with respect to the nozzle hole plate 30 shown in FIG. 1B.

Here, the long axis X1 and the short axis Y1 belong to an entry-side open end portion 31*a* that is positioned on the valve body 10 side (the upper side in FIG. 1A) of the nozzle hole 31, and the long axis X2 and the short axis Y2 belong to an exit-side open end portion 31*b* that is positioned on the opposite side from the valve body 10 (i.e., on the lower side in FIG. 1A) of the nozzle hole 31.

In the example embodiments described below, the oval shape is not limited to a closed curve that is axisymmetrical with respect to at least one axis, such as an ellipse, egg-shape, or oval, but also includes a closed curve that is not symmetrical.

The nozzle hole 31 is formed in a tapered shape such that a flow path sectional area becomes larger from the entry-side open end portion 31*a* toward the exit-side open end portion 31*b*. The nozzle hole 31 is formed such that the center of the exit-side open end portion 31*b* (i.e., the point of intersection between the long axis X2 and the short axis Y2) is positioned farther toward an outer edge portion side of the nozzle hole plate 30 than the center of the entry-side open end portion 31*a* (i.e., the point of intersection between the long axis X1 and the short axis Y1) is.

Figure 1C:
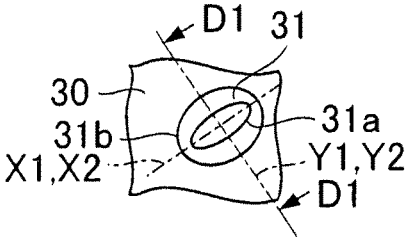
FIG. 1C is a view from direction C1 in FIG. IA.
Figure 1D:
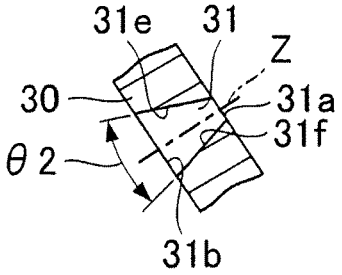
FIG. 1D is a sectional view taken along line D1-D1 in FIG. 1C.

The nozzle hole 31 is formed such that a second angle θ2 that is an intersecting angle of opposing nozzle hole inner wall surface portions 31*e* and 31*f* in an oblique section (see FIGS. 1C and 1D) along the short axes Y1 and Y2 of the entry-side open end portion 31*a* and the exit-side open end portion 31*b*, is greater than a first angle θ1 that is an intersecting angle of opposing nozzle hole inner wall surface portions 31*c* and 31*d* in a longitudinal section (see FIG. 1A) along the long axes X1 and X2 of the entry-side open end portion 31*a* and the exit-side open end portion 31*b*. In the drawings, reference character Z represents an axis of the nozzle hole 31.

Also, the flow path cross-section of the entry-side open end portion 31*a* may be set to satisfy the relationship $1<Ld/Sd\leq 3.5$. Here, Ld is the long diameter of the entry-side open end portion 31*a*, and Sd is the short diameter of the entry-side open end portion 31*a*.

Figure 2:
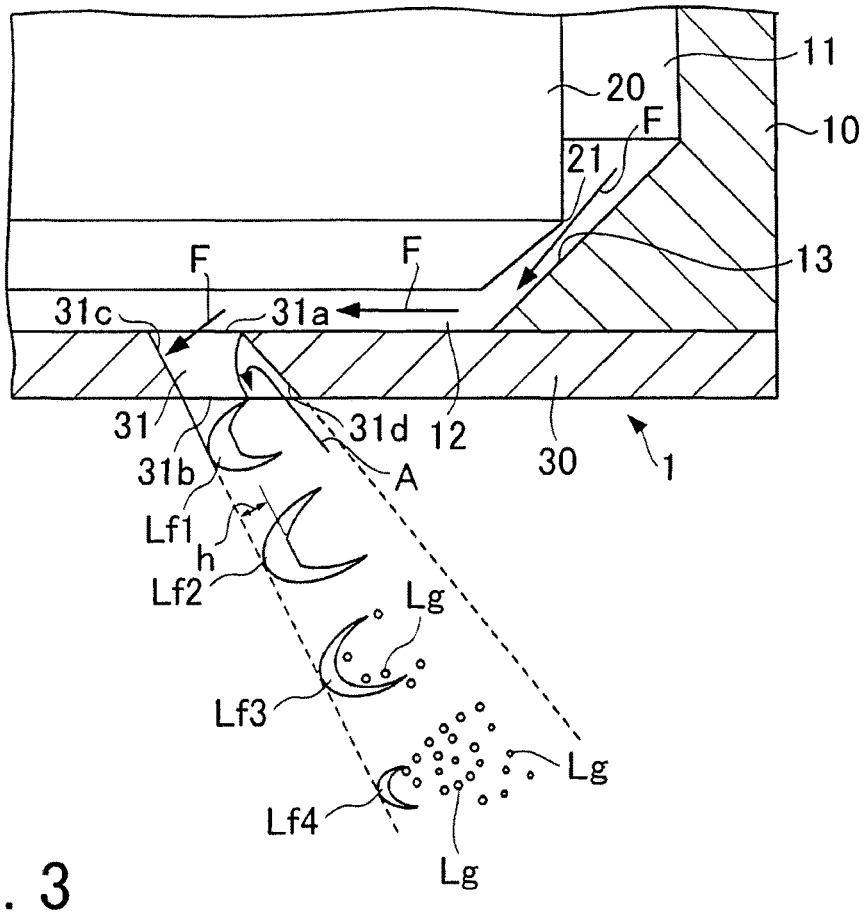
FIG. 2 is a view showing a frame format of the operation of the fuel injection valve according to the first example embodiment of the invention.

Next, the operation of the fuel injection valve 1 according to this example embodiment will be described with reference to FIG. 2. In FIG. 2, F represents the flow of fuel, A represents the flow of air, Lf1, Lf2, Lf3, and Lf4 represent a fuel liquid film cross-section, Lg represents fuel droplets, and H represents a thickness of the fuel liquid film.

The fuel injection valve 1 performs a fuel injection with fuel being delivered from the pump, not shown, into the fuel supply passage 11 of the valve body 10. In the fuel injection valve 1, when the valve element 20 is lifted upward by the valve driving device, not shown, fuel in the fuel supply passage 11 is made to flow into the nozzle hole 31 via a gap between the valve seat 13 and the outer peripheral surface portion of the lower end portion of the valve element 20, and the valve hole 12, and is injected out in a downward direction from the exit-side open end portion 31*b* of the nozzle hole 31.

As a result, the fuel in the fuel supply passage 11 flows into the nozzle hole 31 via the gap between the valve seat 13 and the outer peripheral surface portion of the lower end portion of the valve element 20, and the valve hole 12, and is injected below the fuel injection valve 1 from the nozzle hole 31.

Regarding the fuel headed from the fuel supply passage 11 toward the nozzle hole 31, the fuel injection valve 1 generates turbulence in the flow F of fuel by a pressure loss being applied by the valve seat 13, the valve element 20, and the nozzle hole plate 30, and when the fuel flows into the nozzle hole 31 from the entry-side open end portion 31*a*, it is made to flow in close to the inner wall surface portion 31*c* of the nozzle hole 31, such that boundary layer peeling is created.

The fuel liquid film cross-section of the fuel injected from the fuel injection valve 1 expands from Lf1 to Lf2 as the fuel becomes farther away from the exit-side open end portion 31*b*, but the fuel droplets Lg diffuse from the fuel main flow, so the fuel liquid film cross-section shrinks from Lf2 to Lf3 and Lf4, and finally disappears.

The relationship shown in expression (1) below is satisfied between the particle diameter PS of the fuel droplets Lg and the thickness h of the fuel liquid film. This expression is referred to as the FRAZER expression.

$$Pd=C(h/V^2)^{1/3} \quad (1)$$

Here, V is the fuel flow rate and C is a coefficient.

The nozzle hole 31 of the nozzle hole plate 30 of the fuel injection valve 1 according to this example embodiment is formed such that the second angle θ2 that is the intersecting angle of the opposing nozzle hole inner wall surface portions 31*e* and 31*f* in the oblique section along the short axes Y1 and Y2 of the entry-side open end portion 31*a* and the exit-side open end portion 31*b*, is greater than the first angle θ1 that is the intersecting angle of the opposing nozzle hole inner wall surface portions 31*c* and 31*d* in the longitudinal section along the long axes X1 and X2 of the entry-side open end portion 31*a* and the exit-side open end portion 31*b*. In the drawings, reference character Z represents an axis of the nozzle hole 31.

Therefore, the fuel injection valve 1 is able to inject fuel downward so that it spreads out in the direction of the short axis Y2 of the exit-side open end portion 31*b* from the nozzle hole 31. Also, the fuel injection valve 1 generates the flow F of fuel that is close to the inner wall surface portion 31*c* of the nozzle hole 31, and thus creates negative pressure in a region on the inner wall surface portion 31*d* side inside the nozzle hole 31. As a result, a flow A of outside air is able to be sucked into the nozzle hole 31.

Thus, regarding the fuel injected out from the nozzle hole 31, the fuel injection valve 1 makes the thickness h of the fuel liquid film in the direction of the long axis X2 of the exit-side open end portion 31*b* thin, and sufficiently spreads the liquid fuel film in the direction of the short axis Y2 of the exit-side open end portion 31*b*, so atomization of the fuel droplets is able to be effectively promoted.

Figure 3:
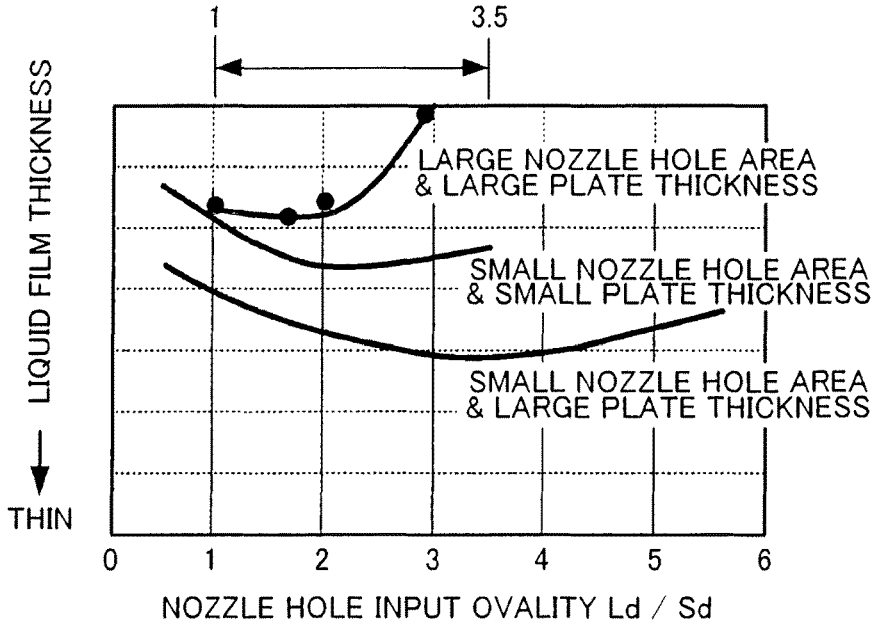
FIG. 3 is a graph illustrating the relationship between a thickness of a fuel liquid film and the shape of a nozzle hole in the fuel injection valve according to the first example embodiment of the invention.

Also, as shown in FIG. 3, the fuel liquid film thickness is able to be made thin by making the flow path cross-section of the entry-side open end portion 31*a* satisfy the relationship of $1<Ld/Sd\leq 3.5$.

(Second Example Embodiment)

Figure 4A:
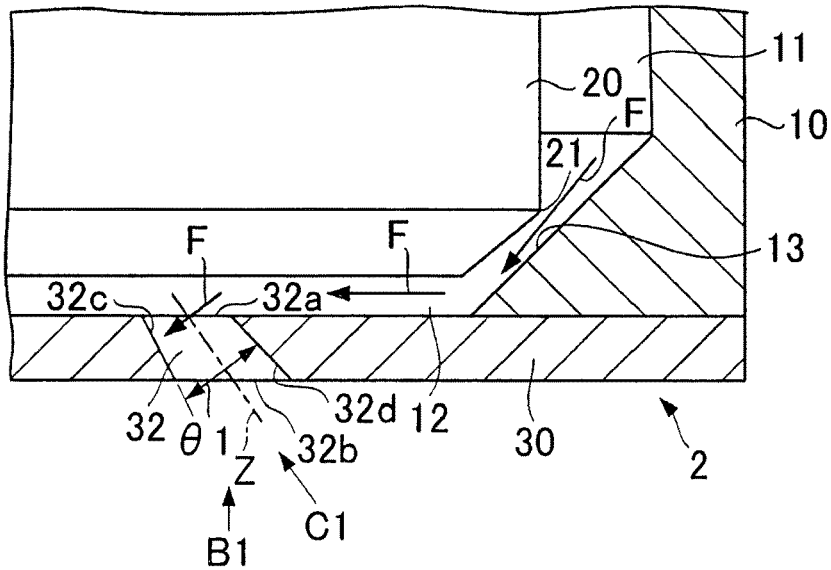
FIG. 4A is a longitudinal sectional view of a tip end portion of a fuel injection valve according to a second example embodiment of the invention.

A fuel injection valve 2 according to a second example embodiment of the invention includes a valve body 10, a valve element 20, and a nozzle hole plate 30, as shown in FIG. 4A. A plurality of nozzle holes 32 that extend through in a plate thickness direction are provided in the nozzle hole plate 30. Hereinafter, these nozzle holes 32 will be described in the singular to simplify the description.

The basic structures of the valve body 10, the valve element 20, and the nozzle hole plate 30 are the same as those described in the first example embodiment above, so portions in FIGS. 4A to 4D that are denoted by the same reference characters as those in FIGS. 1A to 1D are identical to the portions in FIGS. 1A to 1D.

Figure 4B:
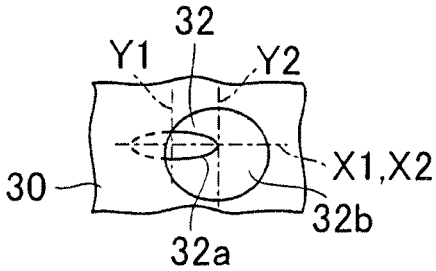
FIG. 4B is a view from direction B2 in FIG. 4A.

The nozzle hole 32 is formed with an flow path cross-section having an oval shape that has long axes X1 and X2 and short axes Y1 and Y2, in a plan view with respect to the nozzle hole plate 30 shown in FIG. 4B.

Here, the long axis X1 and the short axis Y1 belong to an entry-side open end portion 32*a* that is positioned on the valve body 10 side (the upper side in FIG. 4A) of the nozzle hole 32, and the long axis X2 and the short axis Y2 belong to an exit-side open end portion 32*b* that is positioned on the opposite side from the valve body 10 (i.e., on the lower side in FIG. 4A) of the nozzle hole 32.

The nozzle hole 32 is formed in a tapered shape such that a flow path sectional area becomes larger from the entry-side open end portion 32*a* toward the exit-side open end portion 32*b*. The nozzle hole 32 is formed such that the center of the exit-side open end portion 32*b* (i.e., the point of intersection between the long axis X2 and the short axis Y2) is positioned farther toward an outer edge portion side of the nozzle hole plate 30 than the center of the entry-side open end portion 32*a* (i.e., the point of intersection between the long axis X1 and the short axis Y1) is.

The nozzle hole 32 is formed such that a second angle θ2 that is an intersecting angle of opposing nozzle hole inner wall surface portions 32*e* and 32*f* in an oblique section (see FIG. 4D) along the short axes Y1 and Y2 of the entry-side open end portion 32*a* and the exit-side open end portion 32*b*, is greater than a first angle θ1 that is an intersecting angle of opposing nozzle hole inner wall surface portions 32*c* and 32*d* in a longitudinal section (see FIG. 4A) along the long axes X1 and X2 of the entry-side open end portion 32*a* and the exit-side open end portion 32*b*. In the drawings, reference character Z represents an axis of the nozzle hole 32.

Figure 4C:
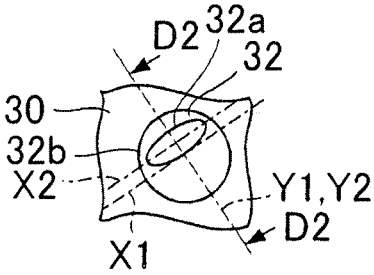
FIG. 4C is a view from direction C2 in FIG. 4A.

Further, the nozzle hole 32 is formed such that the long axis X1 of the entry-side open end portion 32*a* does not overlap with the long axis X2 of the exit-side open end portion 32*b* when the nozzle hole 32 is viewed in the axial direction (see FIG. 4C).

Figure 4D:
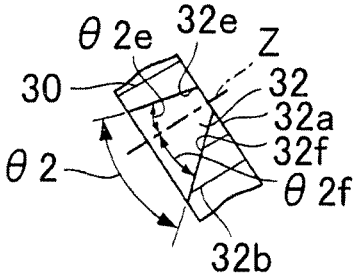
FIG. 4D is a sectional view taken along line D2-D2 in FIG. 4C.

As a result, the nozzle hole 32 is such that an outside angle θ2*f* that is an intersecting angle between the axis Z and the nozzle hole inner wall surface portion 32*f* is larger than an inside angle θ2*e* that is the intersecting angle between the axis Z and the nozzle hole inner wall surface portion 32*e*, in an oblique section along the short axes Y1 and Y2 of the entry-side open end portion 32*a* and the exit-side open end portion 32*b* (see FIG. 4D).

Next, the operation of the fuel injection valve 2 according to this example embodiment will be described. The basic operation of this fuel injection valve 2 is the same as that in the first example embodiment described above, so a description thereof will be omitted.

The fuel injection valve 2 performs a fuel injection with fuel being delivered from the pump, not shown, into the fuel supply passage 11 of the valve body 10. In the fuel injection valve 2, when the valve element 20 is lifted upward by the valve driving device, not shown, fuel in the fuel supply passage 11 is made to flow into the nozzle hole 31 via a gap between the valve seat 13 and the outer peripheral surface portion of the lower end portion of the valve element 20, and the valve hole 12, and is injected out in a downward direction from the exit-side open end portion 32*b* of the nozzle hole 32.

Regarding the fuel headed from the fuel supply passage 11 toward the nozzle hole 32, the fuel injection valve 2 generates turbulence in the flow F of fuel by receiving a pressure loss by the valve seat 13, the valve element 20, and the nozzle hole plate 30, and when the fuel flows into the nozzle hole 32 from the entry-side open end portion 32*a*, it is made to flow in close to the inner wall surface portion 32*c* of the nozzle hole 32, such that boundary layer peeling is created.

The fuel injected from the fuel injection valve 2 expands the fuel liquid film cross-section as the fuel becomes farther away from the exit-side open end portion 32*b*, but the fuel droplets diffuse from the fuel main flow, so the fuel liquid film cross-section gradually shrinks and finally disappears.

In the fuel injection valve 2 according to this example embodiment, the nozzle hole 32 of the nozzle hole plate 30 is formed such that the second angle θ2 that is the intersecting angle of the opposing nozzle hole inner wall surface portions 32*e* and 32*f* in the oblique section along the short axes Y1 and Y2 of the entry-side open end portion 32*a* and the exit-side open end portion 32*b*, is greater than the first angle θ1 that is the intersecting angle of the opposing nozzle hole inner wall surface portions 32*c* and 32*d* in the longitudinal section along the long axes X1 and X2 of the entry-side open end portion 32*a* and the exit-side open end portion 32*b*.

Therefore, the fuel injection valve 2 is able to inject fuel downward so that it spreads out in the direction of the short axis Y2 of the exit-side open end portion 32*b* from the nozzle hole 32. Also, the fuel injection valve 2 generates the flow F of fuel that is close to the inner wall surface portion 32*c* of the nozzle hole 32, and thus creates negative pressure in a region on the inner wall surface portion 32*d* side inside the nozzle hole 32. As a result, a flow A of outside air is able to be sucked into the nozzle hole 32.

Thus, regarding the fuel injected out from the nozzle hole 32, the fuel injection valve 2 makes the thickness h of the fuel liquid film in the direction of the long axis X2 of the exit-side open end portion 32*b* thin (see FIG. 2), and sufficiently spreads the liquid fuel film in the direction of the short axis Y2 of the exit-side open end portion 32*b*, so atomization of the fuel droplets is able to be effectively promoted.

Further, in the fuel injection valve 2 according to this example embodiment, the nozzle hole 32 is formed such that the long axis X1 of the entry-side open end portion 32*a* does not overlap with the long axis X2 of the exit-side open end portion 32*b* when the nozzle hole 32 of the nozzle hole plate 30 is viewed in the axial direction.

As a result, the nozzle hole 32 is such that the outside angle θ2*f* that is the intersecting angle between the axis Z and the nozzle hole inner wall surface portion 32*f* is larger than the inside angle θ2*e* that is the intersecting angle between the axis Z and the nozzle hole inner wall surface portion 32*e*, in the oblique section along the short axes Y1 and Y2 of the entry-side open end portion 32*a* and the exit-side open end portion 32*b* (see FIG. 4D).

Therefore, the atomized fuel is sprayed in an asymmetrical area centered around the axis Z of the nozzle hole 32, in the oblique section along the short axes Y1 and Y2 of the entry-side open end portion 32*a* and the exit-side open end portion 32*b* (see FIG. 4D). This makes it is possible to inhibit the fuel injection valve 2 from interfering with fuel that is injected from an adjacent nozzle hole 32.

(Third Example Embodiment)

Figure 5A:
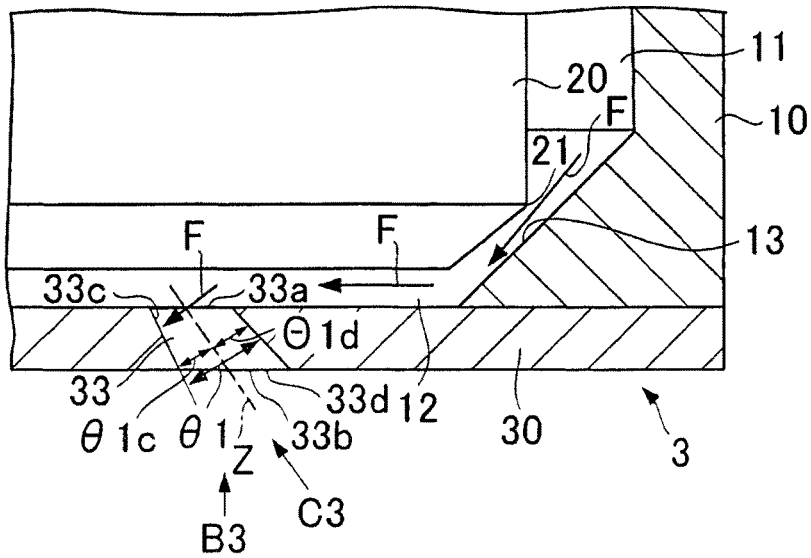
FIG. 5A is a longitudinal sectional view of a tip end portion of a fuel injection valve according to a third example embodiment of the invention.

A fuel injection valve 3 according to a third example embodiment of the invention includes a valve body 10, a valve element 20, and a nozzle hole plate 30, as shown in FIG. 5A. A plurality of nozzle holes 33 that extend through in a plate thickness direction are provided in the nozzle hole plate 30. Hereinafter, these nozzle holes 33 will be described in the singular to simplify the description.

The basic structures of the valve body 10, the valve element 20, and the nozzle hole plate 30 are the same as those described in the first example embodiment above, so portions in FIGS. 5A to 5D that are denoted by the same reference characters as those in FIGS. 1A to 1D are identical to the portions in FIGS. 1A to 1D.

Figure 5B:
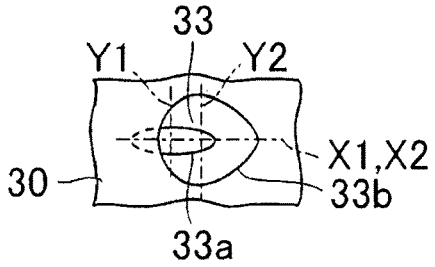
FIG. 5B is a view from direction B3 in FIG. 5A.
Figure 5C:
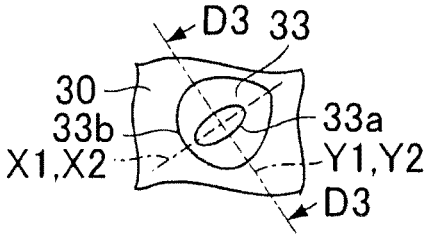
FIG. 5C is a view from direction C3 in FIG. 5A.
Figure 5D:
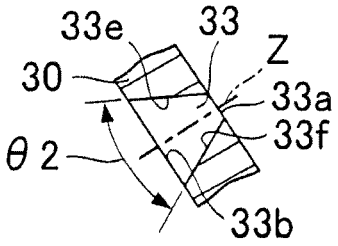
FIG. 5D is a sectional view taken along line D3-D3 in FIG. 5C.

The nozzle hole 33 is formed with a flow path cross-section having an oval shape that has long axes X1 and X2 and short axes Y1 and Y2, in a plan view with respect to the nozzle hole plate 30 shown in FIG. 5B.

Here, the long axis X1 and the short axis Y1 belong to an entry-side open end portion 33*a* that is positioned on the valve body 10 side (the upper side in FIG. 5A) of the nozzle hole 33, and the long axis X2 and the short axis Y2 belong to an exit-side open end portion 33*b* that is positioned on the opposite side from the valve body 10 (i.e., on the lower side in FIG. 5A) of the nozzle hole 33. Further, the flow path cross-section of the exit-side open end portion 33*b* of the nozzle hole 33 is formed asymmetrical with respect to the short axis Y2.

The nozzle hole 33 is formed in a tapered shape such that a flow path sectional area becomes larger from the entry-side open end portion 33*a* toward the exit-side open end portion 33*b*. The nozzle hole 33 is formed such that the center of the exit-side open end portion 33*b* (i.e., the point of intersection between the long axis X2 and the short axis Y2) is positioned farther toward an outer edge portion side of the nozzle hole plate 30 than the center of the entry-side open end portion 33*a* (i.e., the point of intersection between the long axis X1 and the short axis Y1) is.

The nozzle hole 33 is formed such that a second angle θ2 that is an intersecting angle of opposing nozzle hole inner wall surface portions 33*e* and 33*f* in an oblique section (see FIGS. 5C and 5D) along the short axes Y1 and Y2 of the entry-side open end portion 33*a* and the exit-side open end portion 33*b*, is greater than a first angle θ1 that is an intersecting angle of opposing nozzle hole inner wall surface portions 33*c* and 33*d* in a longitudinal section (see FIG. 5A) along the long axes X1 and X2 of the entry-side open end portion 33*a* and the exit-side open end portion 33*b*. In the drawings, reference character Z represents an axis of the nozzle hole 33.

Further, as described above, the flow path cross-section of the exit-side open end portion 33*b* of the nozzle hole 33 is formed asymmetrical with respect to the short axis Y2, so the curvature of the nozzle hole inner wall surface portion 33*c* on the center side of the nozzle hole plate 30 where the fuel runs down at the nozzle hole 33 becomes smaller.

As a result, an outside angle θ2*d* that is an intersecting angle between the axis Z and the nozzle hole inner wall surface portion 33*d* is larger than an inside angle θ1*c* that is the intersecting angle between the axis Z and the nozzle hole inner wall surface portion 33*c*, in a longitudinal section along the long axes X1 and X2 of the entry-side open end portion 33*a* and the exit-side open end portion 33*b* (see FIG. 5A).

Next, the operation of the fuel injection valve 3 according to this example embodiment will be described. The basic operation of this fuel injection valve 3 is the same as that in the first example embodiment described above, so a description thereof will be omitted.

The fuel injection valve 3 performs a fuel injection with fuel being delivered from the pump, not shown, into the fuel supply passage 11 of the valve body 10. In the fuel injection valve 3, when the valve element 20 is lifted upward by the valve driving device, not shown, fuel in the fuel supply passage 11 is made to flow into the nozzle hole 33 via a gap between the valve seat 13 and the outer peripheral surface portion of the lower end portion of the valve element 20, and the valve hole 12, and is injected out in a downward direction from the exit-side open end portion 33*b* of the nozzle hole 33.

Regarding the fuel headed from the fuel supply passage 11 toward the nozzle hole 33, the fuel injection valve 3 generates turbulence in the flow F of fuel by receiving a pressure loss by the valve seat 13, the valve element 20, and the nozzle hole plate 30, and when the fuel flows into the nozzle hole 33 from the entry-side open end portion 33*a*, it is made to flow in close to the inner wall surface portion 33*c* of the nozzle hole 33, such that boundary layer peeling is created.

The fuel injected from the fuel injection valve 3 expands the fuel liquid film cross-section as the fuel becomes farther away from the exit-side open end portion 33*b*, but the fuel droplets diffuse from the fuel main flow, so the fuel liquid film cross-section gradually shrinks and finally disappears.

In the fuel injection valve 3 according to this example embodiment, the nozzle hole 33 of the nozzle hole plate 30 is formed such that the second angle θ2 that is the intersecting angle of the opposing nozzle hole inner wall surface portions 33*e* and 33*f* in the oblique section along the short axes Y1 and Y2 of the entry-side open end portion 33*a* and the exit-side open end portion 33*b*, is greater than the first angle θ1 that is the intersecting angle of the opposing nozzle hole inner wall surface portions 33*c* and 33*d* in the longitudinal section along the long axes X1 and X2 of the entry-side open end portion 33*a* and the exit-side open end portion 33*b*.

Therefore, the fuel injection valve 3 is able to inject fuel downward so that it spreads out in the direction of the short axis Y2 of the exit-side open end portion 33*b* from the nozzle hole 33. Also, the fuel injection valve 3 generates the flow F of fuel that is close to the inner wall surface portion 33*c* of the nozzle hole 33, and thus creates negative pressure in a region on the inner wall surface portion 33*d* side inside the nozzle hole 33. As a result, a flow A of outside air is able to be sucked into the nozzle hole 33.

Thus, regarding the fuel injected out from the nozzle hole 33, the fuel injection valve 3 makes the thickness h of the fuel liquid film in the direction of the long axis X2 of the exit-side open end portion 33*b* thin (see FIG. 2), and sufficiently spreads the liquid fuel film in the direction of the short axis Y2 of the exit-side open end portion 33*b*, so atomization of the fuel droplets is able to be effectively promoted.

Further, in the fuel injection valve 3 according to this example embodiment, the nozzle hole 33 of the nozzle hole plate 30 is such that the flow path cross-section of the exit-side open end portion 33*b* is formed asymmetrical with respect to the short axis Y2, in a plan view with respect to the nozzle hole plate 30.

As a result, the outside angle θ1*d* that is the intersecting angle between the axis Z and the nozzle hole inner wall surface portion 33*d* is larger than the inside angle θ1*c* that is the intersecting angle between the axis Z and the nozzle hole inner wall surface portion 33*c*, in the longitudinal section along the long axes X1 and X2 of the entry-side open end portion 33*a* and the exit-side open end portion 33*b* (see FIG. 5A).

Therefore, the fuel injection valve 3 sufficiently spreads the fuel liquid film in the direction of the long axis X2 of the exit-side open end portion 33*b*, and increases the amount of air sucked into the nozzle hole 33 from outside, so atomization of the fuel droplets is able to be effectively promoted.

(Fourth Example Embodiment)

Figure 6A:
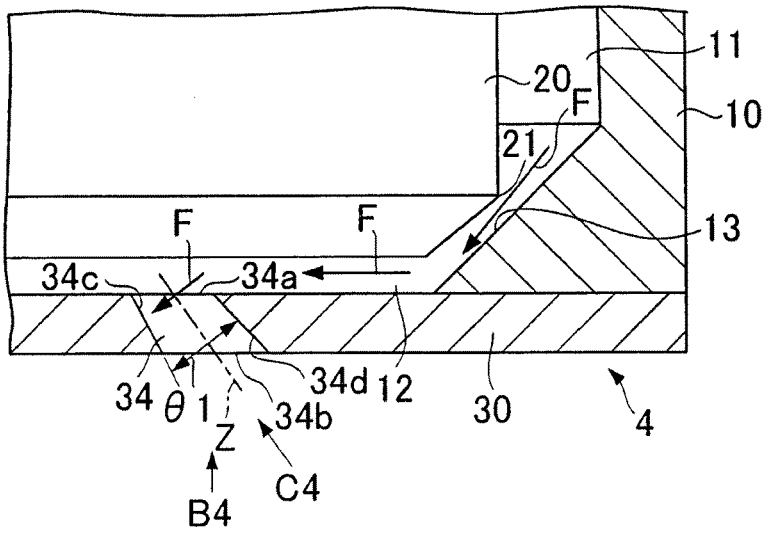
FIG. 6A is a longitudinal sectional view of a tip end portion of a fuel injection valve according to a fourth example embodiment of the invention.

A fuel injection valve 4 according to a fourth example embodiment of the invention includes a valve body 10, a valve element 20, and a nozzle hole plate 30, as shown in FIG. 6A. A plurality of nozzle holes 34 that extend through in a plate thickness direction are provided in the nozzle hole plate 30. Hereinafter, these nozzle holes 34 will be described in the singular to simplify the description.

The basic structures of the valve body 10, the valve element 20, and the nozzle hole plate 30 are the same as those described in the first example embodiment above, so portions in FIGS. 6A to 6E that are denoted by the same reference characters as those in FIGS. 1A to 1D are identical to the portions in FIGS. 1A to 1D.

Figure 6B:
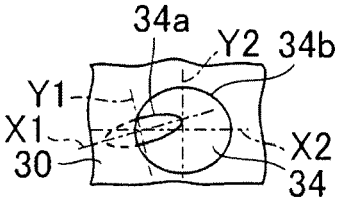
FIG. 6B is a view from direction B4 in FIG. 6A.
Figure 6C:
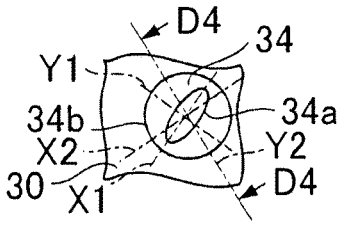
FIG. 6C is a view from direction C4 in FIG. 6A.
Figure 6D:
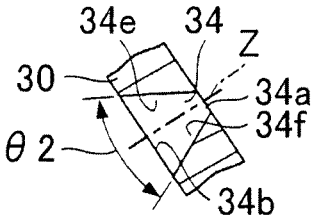
FIG. 6D is a sectional view taken along line D4-D4 in FIG. 6C.

The nozzle hole 34 is formed with a flow path cross-section having an oval shape that has long axes X1 and X2 and short axes Y1 and Y2, in a plan view with respect to the nozzle hole plate 30 shown in FIG. 6B.

Here, the long axis X1 and the short axis Y1 belong to an entry-side open end portion 34*a* that is positioned on the valve body 10 side (the upper side in FIG. 6A) of the nozzle hole 34, and the long axis X2 and the short axis Y2 belong to an exit-side open end portion 34*b* that is positioned on the opposite side from the valve body 10 (i.e., on the lower side in FIG. 6A) of the nozzle hole 34.

The nozzle hole 34 is formed in a tapered shape such that a flow path sectional area becomes larger from the entry-side open end portion 34*a* toward the exit-side open end portion 34*b*. The nozzle hole 34 is formed such that the center of the exit-side open end portion 34*b* (i.e., the point of intersection between the long axis X2 and the short axis Y2) is positioned farther toward an outer edge portion side of the nozzle hole plate 30 than the center of the entry-side open end portion 34*a* (i.e., the point of intersection between the long axis X1 and the short axis Y1) is.

The nozzle hole 34 is formed such that a second angle θ2 that is an intersecting angle of opposing nozzle hole inner wall surface portions 34*e* and 34*f* in an oblique section (see FIGS. 6C and 6D) along the short axis Y2 of the exit-side open end portion 34*b*, is greater than a first angle θ1 that is an intersecting angle of opposing nozzle hole inner wall surface portions 34*c* and 34*d* in a longitudinal section (see FIG. 6A) along the long axis X2 of the exit-side open end portion 34*b*. In the drawings, reference character Z represents an axis of the nozzle hole 34.

Figure 6E:
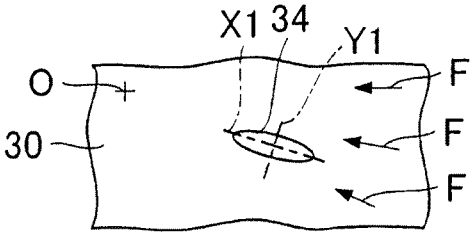
FIG. 6E is a view from direction E4 in FIG. 6A.

Further, the nozzle hole 34 is formed such that the long axis X1 of the entry-side open end portion 34*a* extends toward the center O of the valve hole 12, in a plan view with respect to the nozzle hole plate 30 (see FIG. 6E).

Next, the operation of the fuel injection valve 4 according to this example embodiment will be described. The basic operation of this fuel injection valve 4 is the same as that in the first example embodiment described above, so a description thereof will be omitted.

The fuel injection valve 4 performs a fuel injection with fuel being delivered from the pump, not shown, into the fuel supply passage 11 of the valve body 10. In the fuel injection valve 4, when the valve element 20 is lifted upward by the valve driving device, not shown, fuel in the fuel supply passage 11 is made to flow into the nozzle hole 34 via a gap between the valve seat 13 and the outer peripheral surface portion of the lower end portion of the valve element 20, and the valve hole 12, and is injected out in a downward direction from the exit-side open end portion 34*b* of the nozzle hole 34.

The fuel injected from the fuel injection valve 4 expands the fuel liquid film cross-section as the fuel becomes farther away from the exit-side open end portion 34*b*, but the fuel droplets diffuse from the fuel main flow, so the fuel liquid film cross-section gradually shrinks and finally disappears.

In the fuel injection valve 4 according to this example embodiment, the nozzle hole 34 of the nozzle hole plate 30 is formed such that the second angle θ2 that is the intersecting angle of the opposing nozzle hole inner wall surface portions 34*e* and 34*f* in the oblique section along the short axes Y1 and Y2 of the entry-side open end portion 34*a* and the exit-side open end portion 34*b*, is greater than the first angle θ1 that is the intersecting angle of the opposing nozzle hole inner wall surface portions 34*c* and 34*d* in the longitudinal section along the long axes X1 and X2 of the entry-side open end portion 34*a* and the exit-side open end portion 34*b*.

Therefore, the fuel injection valve 4 is able to inject fuel downward so that it spreads out in the direction of the short axis Y2 of the exit-side open end portion 34*b* from the nozzle hole 34. Also, the fuel injection valve 4 generates the flow F of fuel that is close to the inner wall surface portion 34*c* of the nozzle hole 34, and thus creates negative pressure in a region on the inner wall surface portion 34*d* side inside the nozzle hole 34. As a result, a flow A of outside air is able to be sucked into the nozzle hole 34.

Also, in the fuel injection valve 4 according to this example embodiment, the nozzle hole 34 of the nozzle hole plate 30 is formed such that the long axis X1 of the entry-side open end portion 34*a* extends toward the center O of the valve hole 12, so a flow F of fuel that is close to the inner wall surface portion 34*c* side of the nozzle hole 34 is generated, which causes boundary layer peeling to occur in the fuel that flows through the nozzle hole 34.

Thus, regarding the fuel injected out from the nozzle hole 34, the fuel injection valve 4 makes the thickness h of the fuel liquid film in the direction of the long axis X2 of the exit-side open end portion 34*b* thin (see FIG. 2), and sufficiently spreads the liquid fuel film in the direction of the short axis Y2 of the exit-side open end portion 34*b*, so atomization of the fuel droplets is able to be effectively promoted.

(Fifth Example Embodiment)

Figure 7A:
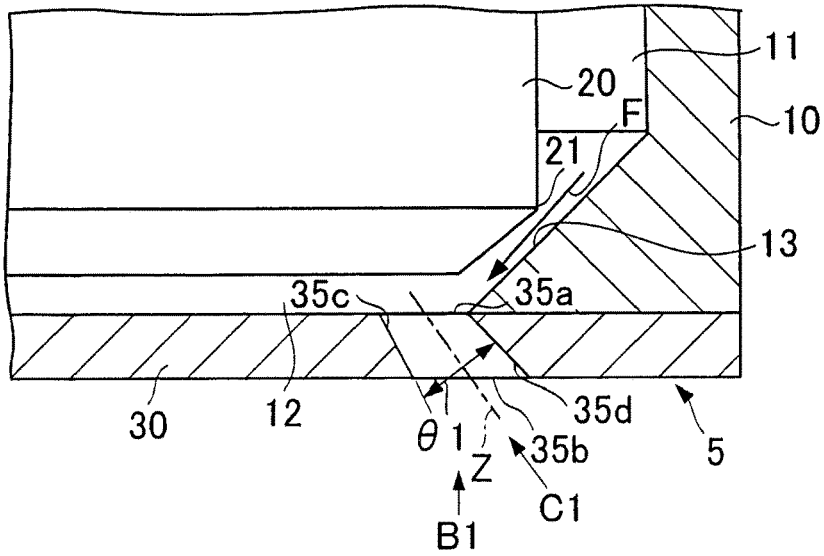
FIG. 7A is a longitudinal sectional view of a tip end portion of a fuel injection valve according to a fifth example embodiment of the invention.

A fuel injection valve 5 according to a fifth example embodiment of the invention includes a valve body 10, a valve element 20, and a nozzle hole plate 30, as shown in FIG. 7A. A plurality of nozzle holes 35 that extend through in a plate thickness direction are provided in the nozzle hole plate 30. Hereinafter, these nozzle holes 35 will be described in the singular to simplify the description.

The basic structures of the valve body 10, the valve element 20, and the nozzle hole plate 30 are the same as those described in the first example embodiment above, so portions in FIGS. 7A to 7D that are denoted by the same reference characters as those in FIGS. 1A to 1D are identical to the portions in FIGS. 1A to 1D.

Figure 7B:
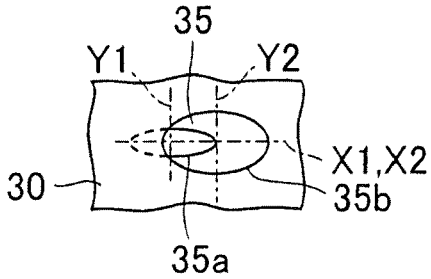
FIG. 7B is a view from direction B5 in FIG. 7A.
Figure 7C:
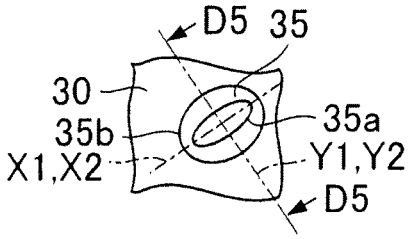
FIG. 7C is a view from direction C5 in FIG. 7A.
Figure 7D:
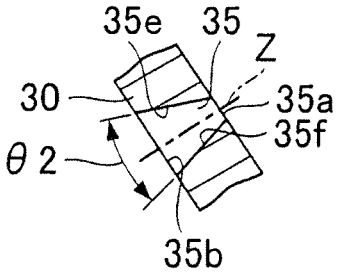
FIG. 7D is a sectional view taken along line D5-D5 in FIG. 7C.

The nozzle hole 35 is formed with a flow path cross-section having an oval shape that has long axes X1 and X2 and short axes Y1 and Y2, in a plan view with respect to the nozzle hole plate 30 shown in FIG. 7B.

Here, the long axis X1 and the short axis Y1 belong to an entry-side open end portion 35*a* that is positioned on the valve body 10 side (the upper side in FIG. 7A) of the nozzle hole 35, and the long axis X2 and the short axis Y2 belong to an exit-side open end portion 35*b* that is positioned on the opposite side from the valve body 10 (i.e., on the lower side in FIG. 7A) of the nozzle hole 35.

The nozzle hole 35 is formed in a tapered shape such that a flow path sectional area becomes larger from the entry-side open end portion 35*a* toward the exit-side open end portion 35*b*. The nozzle hole 35 is formed such that the center of the exit-side open end portion 35*b* (i.e., the point of intersection between the long axis X2 and the short axis Y2) is positioned farther toward an outer edge portion side of the nozzle hole plate 30 than the center of the entry-side open end portion 35*a* (i.e., the point of intersection between the long axis X1 and the short axis Y1) is.

The nozzle hole 35 is formed such that a second angle θ2 that is an intersecting angle of opposing nozzle hole inner wall surface portions 35*e* and 35*f* in an oblique section (see FIGS. 7C and 7D) along the short axes Y1 and Y2 of the entry-side open end portion 35*a* and the exit-side open end portion 35*b*, is greater than a first angle θ1 that is an intersecting angle of opposing nozzle hole inner wall surface portions 35*c* and 35*d* in a longitudinal section (see FIG. 7A) along the long axes X1 and X2 of the entry-side open end portion 35*a* and the exit-side open end portion 35*b*. In the drawings, reference character Z represents an axis of the nozzle hole 35.

Further, the entry-side open end portion 35*a* of the nozzle hole 35 is formed adjacent to the inner peripheral edge portion of the valve body 10.

Next, the operation of the fuel injection valve 5 according to this example embodiment will be described. The basic operation of this fuel injection valve 5 is the same as that in the first example embodiment described above, so a description thereof will be omitted.

The fuel injection valve 5 performs a fuel injection with fuel being delivered from the pump, not shown, into the fuel supply passage 11 of the valve body 10. That is, in the fuel injection valve 5, when the valve element 20 is lifted upward by the valve driving device, not shown, fuel in the fuel supply passage 11 is made to flow into the nozzle hole 35 via a gap between the valve seat 13 and the outer peripheral surface portion of the lower end portion of the valve element 20, and the valve hole 12, and is injected out in a downward direction from the exit-side open end portion 35*b* of the nozzle hole 35.

The fuel injected from the fuel injection valve 5 expands the fuel liquid film cross-section as the fuel becomes farther away from the exit-side open end portion 35*b*, but the fuel droplets diffuse from the fuel main flow, so the fuel liquid film cross-section gradually shrinks and finally disappears.

In the fuel injection valve 5 according to this example embodiment, the nozzle hole 35 of the nozzle hole plate 30 is formed such that the second angle θ2 that is the intersecting angle of the opposing nozzle hole inner wall surface portions 35*e* and 35*f* in the oblique section along the short axes Y1 and Y2 of the entry-side open end portion 35*a* and the exit-side open end portion 35*b*, is greater than the first angle θ1 that is the intersecting angle of the opposing nozzle hole inner wall surface portions 35*c* and 35*d* in the longitudinal section along the long axes X1 and X2 of the entry-side open end portion 35*a* and the exit-side open end portion 35*b*.

Therefore, the fuel injection valve 5 is able to inject fuel downward so that it spreads out in the direction of the short axis Y2 of the exit-side open end portion 35*b* from the nozzle hole 35. Also, the fuel injection valve 5 generates the flow F of fuel that is close to the inner wall surface portion 35*c* of the nozzle hole 35, and thus creates negative pressure in a region on the inner wall surface portion 35*d* side inside the nozzle hole 35. As a result, a flow A of outside air is able to be sucked into the nozzle hole 35.

Thus, regarding the fuel injected out from the nozzle hole 35, the fuel injection valve 5 makes the thickness h of the fuel liquid film in the direction of the long axis X2 of the exit-side open end portion 35*b* thin (see FIG. 2), and sufficiently spreads the liquid fuel film in the direction of the short axis Y2 of the exit-side open end portion 35*b*, so atomization of the fuel droplets is able to be effectively promoted.

Also, in the fuel injection valve 5 according to this example embodiment, the nozzle hole 35 of the nozzle hole plate 30 is formed such that the entry-side open end portion 35*a* is adjacent to the inner peripheral edge portion of the valve hole 12 of the valve body 10. Therefore, the fuel injection valve 5 leads the fuel that flows between the valve seat 13 of the valve body 10 and the outer peripheral surface portion of the valve element 20 directly to the nozzle hole 35.

Thus, regarding the fuel injected out from the nozzle hole 35, the fuel injection valve 5 keeps the disturbance in the flow of fuel that flows through the valve body 10 from attenuating easily, so atomization of the fuel droplets is able to be effectively promoted.

(Sixth Example Embodiment)

Figure 8A:
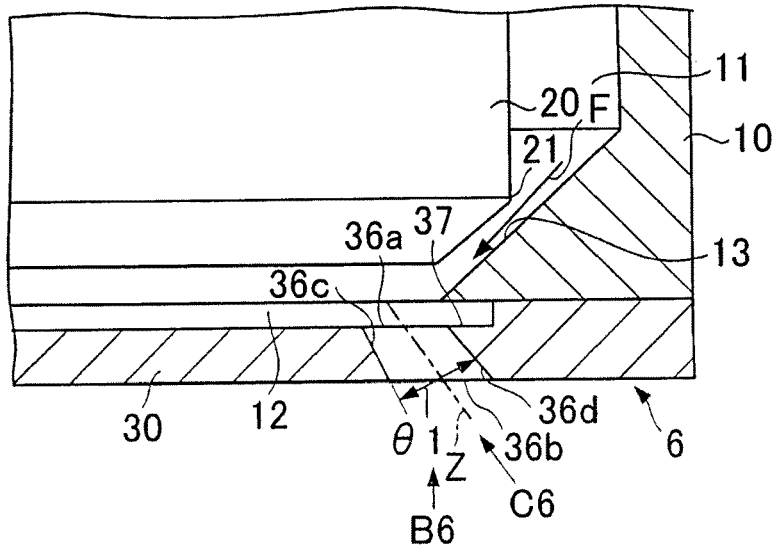
FIG. 8A is a longitudinal sectional view of a tip end portion of a fuel injection valve according to a sixth example embodiment of the invention.

A fuel injection valve 6 according to a fifth example embodiment of the invention includes a valve body 10, a valve element 20, and a nozzle hole plate 30, as shown in FIG. 8A. A plurality of nozzle holes 36 that extend through in a plate thickness direction are provided in the nozzle hole plate 30. Hereinafter, these nozzle holes 36 will be described in the singular to simplify the description.

The basic structures of the valve body 10, the valve element 20, and the nozzle hole plate 30 are the same as those described in the first example embodiment above, so portions in FIGS. 8A to 8D that are denoted by the same reference characters as those in FIGS. 1A to 1D are identical to the portions in FIGS. 1A to 1D.

In this fuel injection valve 6, a recessed portion 37 that surrounds the periphery of the inner peripheral edge portion of the valve hole 12 and faces the valve body 10 is formed on the nozzle hole plate 30.

Figure 8B:
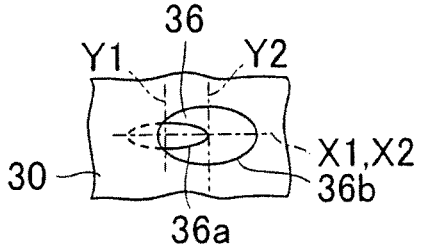
FIG. 8B is a view from direction B6 in FIG. 8A.
Figure 8C:
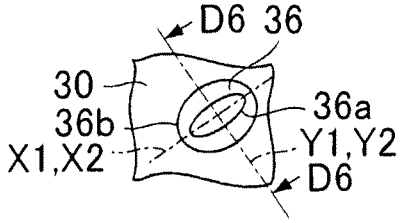
FIG. 8C is a view from direction C6 in FIG. 8A.
Figure 8D:
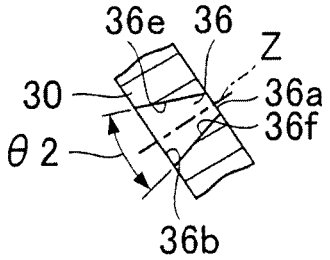
FIG. 8D is a sectional view taken along line D6-D6 in FIG. 8C.

The nozzle hole 36 is formed with a flow path cross-section having an oval shape that has long axes X1 and X2 and short axes Y1 and Y2, in a plan view with respect to the nozzle hole plate 30 shown in FIG. 8B.

Here, the long axis X1 and the short axis Y1 belong to an entry-side open end portion 36*a* that is positioned on the valve body 10 side (the upper side in FIG. 8A) of the nozzle hole 36, and the long axis X2 and the short axis Y2 belong to an exit-side open end portion 36*b* that is positioned on the opposite side from the valve body 10 (i.e., on the lower side in FIG. 8A) of the nozzle hole 36.

The nozzle hole 36 is formed in a tapered shape such that a flow path sectional area becomes larger from the entry-side open end portion 36*a* toward the exit-side open end portion 36*b*. The nozzle hole 36 is formed such that the center of the exit-side open end portion 36*b* (i.e., the point of intersection between the long axis X2 and the short axis Y2) is positioned farther toward an outer edge portion side of the nozzle hole plate 30 than the center of the entry-side open end portion 36*a* (i.e., the point of intersection between the long axis X1 and the short axis Y1) is.

The nozzle hole 36 is formed such that a second angle θ2 that is an intersecting angle of opposing nozzle hole inner wall surface portions 36*e* and 36*f* in an oblique section (see FIGS. 8C and 8D) along the short axes Y1 and Y2 of the entry-side open end portion 36*a* and the exit-side open end portion 36*b*, is greater than a first angle θ1 that is an intersecting angle of opposing nozzle hole inner wall surface portions 36*c* and 36*d* in a longitudinal section (see FIG. 8A) along the long axes X1 and X2 of the entry-side open end portion 36*a* and the exit-side open end portion 36*b*. In the drawings, reference character Z represents an axis of the nozzle hole 36.

Further, the entry-side open end portion 36*a* of the nozzle hole 36 is formed adjacent to the inner peripheral edge portion of the valve body 10.

Next, the operation of the fuel injection valve 6 according to this example embodiment will be described. The basic operation of this fuel injection valve 6 is the same as that in the first example embodiment described above, so a description thereof will be omitted.

The fuel injection valve 6 performs a fuel injection with fuel being delivered from the pump, not shown, into the fuel supply passage 11 of the valve body 10. That is, in the fuel injection valve 6, when the valve element 20 is lifted upward by the valve driving device, not shown, fuel in the fuel supply passage 11 is made to flow into the nozzle hole 36 via a gap between the valve seat 13 and the outer peripheral surface portion of the lower end portion of the valve element 20, and the valve hole 12, and is injected out in a downward direction from the exit-side open end portion 36*b* of the nozzle hole 36.

The fuel injected from the fuel injection valve 6 expands the fuel liquid film cross-section as the fuel becomes farther away from the exit-side open end portion 36*b*, but the fuel droplets diffuse from the fuel main flow, so the fuel liquid film cross-section gradually shrinks and finally disappears.

In the fuel injection valve 6 according to this example embodiment, the nozzle hole 36 of the nozzle hole plate 30 is formed such that the second angle θ2 that is the intersecting angle of the opposing nozzle hole inner wall surface portions 36*e* and 36*f* in the oblique section along the short axes Y1 and Y2 of the entry-side open end portion 36*a* and the exit-side open end portion 36*b*, is greater than the first angle θ1 that is the intersecting angle of the opposing nozzle hole inner wall surface portions 36*c* and 36*d* in the longitudinal section along the long axes X1 and X2 of the entry-side open end portion 36*a* and the exit-side open end portion 36*b*.

Therefore, the fuel injection valve 6 is able to inject fuel downward so that it spreads out in the direction of the short axis Y2 of the exit-side open end portion 36*b* from the nozzle hole 36. Also, the fuel injection valve 6 generates the flow F of fuel that is close to the inner wall surface portion 36*c* of the nozzle hole 36, and thus creates negative pressure in a region on the inner wall surface portion 36*d* side inside the nozzle hole 36. As a result, a flow A of outside air is able to be sucked into the nozzle hole 36.

Thus, regarding the fuel injected out from the nozzle hole 36, the fuel injection valve 6 makes the thickness h of the fuel liquid film in the direction of the long axis X2 of the exit-side open end portion 36*b* thin (see FIG. 2), and sufficiently spreads the liquid fuel film in the direction of the short axis Y2 of the exit-side open end portion 36*b*, so atomization of the fuel droplets is able to be effectively promoted.

Also, in the fuel injection valve 6 according to this example embodiment, the nozzle hole 36 of the nozzle hole plate 30 is formed such that the entry-side open end portion 36*a* is adjacent to the inner peripheral edge portion of the valve hole 12 of the valve body 10. Therefore, the fuel injection valve 6 leads the fuel that flows between the valve seat 13 of the valve body 10 and the outer peripheral surface portion of the valve element 20 directly to the nozzle hole 36.

Thus, regarding the fuel injected out from the nozzle hole 36, the fuel injection valve 6 keeps the disturbance in the fuel that flows through the valve body 10 from attenuating easily, so atomization of the fuel droplets is able to be effectively promoted.

Furthermore, in this fuel injection valve 6 according to this example embodiment, a recessed portion 37 that surrounds the periphery of the inner peripheral edge portion of the valve hole 12 and faces the valve body 10 is formed on the nozzle hole plate 30. This structure keeps the entry-side open end portion 36*a* of the nozzle hole 36 from overlapping with the end portion of the valve body 10, so the machining accuracy of the nozzle hole 36 does not have be as high.

Also, with the fuel injection valve 6, stagnation of fuel occurs between the recessed portion 37 and the end portion of the valve body 10, and disturbance in the fuel that flows through the nozzle hole 36 expands, so atomization of the fuel droplets of the fuel that is injected out from the nozzle hole is able to be more effectively promoted.

The technical scope of the fuel injection valve of the invention is not limited to the example embodiments described above, but includes various modifications to the constituent elements described the claims without departing from the scope of the invention.

In the example embodiments described above, the long axis X1 of the entry-side open end portion 31*a* to 33*a*, 35*a*, and 36*a* of the nozzle hole 31 to 33, 35, and 36 and the long axis X2 of the exit-side open end portion 31*b* to 33*b*, 35*b*, and 36*b* of the nozzle hole 31 to 33, 35, and 36 extend in substantially the same direction, and the short axis Y1 of the entry-side open end portion 31*a* to 33*a*, 35*a*, and 36*a* of the nozzle hole 31 to 33, 35, and 36 and the short axis Y2 of the exit-side open end portion 31*b* to 33*b*, 35*b*, and 36*b* of the nozzle hole 31 to 33, 35, and 36 extend in substantially the same direction. Alternatively, the long axis X1 of the entry-side open end portion 31*a* to 33*a*, 35*a*, and 36*a* of the nozzle hole 31 to 33, 35, and 36 and the short axis Y2 of the exit-side open end portion 31*b* to 33*b*, 35*b*, and 36*b* of the nozzle hole 31 to 33, 35, and 36 may extend in substantially the same direction, and the short axis Y1 of the entry-side open end portion 31*a* to 33*a*, 35*a*, and 36*a* of the nozzle hole 31 to 33, 35, and 36 and the long axis X2 of the exit-side open end portion 31*b* to 33*b*, 35*b*, and 36*b* of the nozzle hole 31 to 33, 35, and 36 may extend in substantially the same direction.

As described above, the fuel injection valve of the invention sufficiently spreads out the fuel liquid film that is injected out from the nozzle hole, and is thus effective in promoting atomization of fuel droplets. This fuel injection valve is useful in generally a variety of types of internal combustion engines.

The invention claimed is:

1. A fuel injection valve comprising:

a valve body that includes a valve hole;

a valve element provided in the valve body so as to open and close the valve hole; and a nozzle hole plate provided in the valve body so as to cover the valve hole, wherein:

a nozzle hole that extends through in a plate thickness direction is formed in the nozzle hole plate, a flow path cross-section of the nozzle hole is formed such that, in a plan view with respect to the nozzle hole plate, an entry-side open end portion of the nozzle hole that is positioned on a valve body side is formed in an oval shape having a long axis and a short axis, and the nozzle hole is formed such that a second angle that is an intersecting angle of opposing nozzle hole inner wall surface portions in a cross-section along the short axis of the entry-side open end portion is greater than a first angle that is an intersecting angle of opposing nozzle hole inner wall surface portions in a cross-section along the long axis of the entry-side open end portion.

2. The fuel injection valve according to claim 1, wherein the flow path cross-section of the nozzle hole is formed in a tapered shape such that a flow path sectional area becomes larger from the entry-side open end portion positioned on the valve body side toward an exit-side open end portion positioned on an opposite side from the valve body.

3. The fuel injection valve according to claim 1, wherein a center of an exit-side open end portion of the nozzle hole is formed positioned farther toward an outer edge portion side of the nozzle hole plate than a center of the entry-side open end portion.

4. The fuel injection valve according to claim 1, wherein the nozzle hole is formed such that the center of an exit-side open end portion and the center of the entry-side open end portion do not overlap with each other in an axial view of the nozzle hole.

5. The fuel injection valve according to claim 1, wherein the nozzle hole is formed such that an outside angle that is an intersecting angle of an axis of the nozzle hole and the nozzle hole inner wall surface portion positioned on an outer edge portion side of the nozzle hole plate is larger than an inside angle that is an intersecting angle of the axis of the nozzle hole and the nozzle hole inner wall surface portion positioned on a center side of the nozzle hole plate, in a cross-section along the long axis of the entry-side open end portion.

6. The fuel injection valve according to claim 1, wherein the nozzle hole is formed such that the long axis of the entry-side open end portion extends toward a center of the valve hole.

7. The fuel injection valve according to claim 1, wherein the nozzle hole is formed such that the entry-side open end portion is adjacent to an edge portion of the valve hole.

8. The fuel injection valve according to claim 1, wherein a recessed portion that surrounds a periphery of the valve hole is formed in a portion of the nozzle hole plate that faces the valve body.

9. A fuel injection valve comprising:

a valve body that includes a valve hole;

a valve element provided in the-valve body so as to open and close the valve hole; and a nozzle hole plate provided in the valve body so as to cover the valve hole, wherein:

a nozzle hole that extends through in a plate thickness direction is formed in the nozzle hole plate, a flow path cross-section of the nozzle hole being formed such that an entry-side open end portion that is positioned on a valve body side is formed in an oval shape having a long axis and a short axis, in a plan view with respect to the nozzle hole plate, the nozzle hole is formed such that a second angle that is an intersecting angle of opposing nozzle hole inner wall surface portions in a cross-section along the short axis of the entry-side open end portion is greater than a first angle that is an intersecting angle of opposing nozzle hole inner wall surface portions in a cross-section along the long axis of the entry-side open end portion, and a recessed portion that surrounds a periphery of the valve hole is formed in a portion of the nozzle hole plate that faces the valve body.

10. The fuel injection valve according to claim 9, wherein the flow path cross-section of the nozzle hole is formed in a tapered shape such that a flow path sectional area becomes larger from the entry-side open end portion positioned on the valve body side toward an exit-side open end portion positioned on an opposite side from the valve body side.

11. The fuel injection valve according to claim 9, wherein a center of an exit-side open end portion of the nozzle hole is formed positioned farther toward an outer edge portion side of the nozzle hole plate than a center of the entry-side open end portion.

12. The fuel injection valve according to claim 9, wherein the nozzle hole is formed such that the center of an exit-side open end portion and the center of the entry-side open end portion do not overlap with each other in an axial view of the nozzle hole.

13. The fuel injection valve according to claim 9, wherein the nozzle hole is formed such that an outside angle that is an intersecting angle of an axis of the nozzle hole and the nozzle hole inner wall surface portion positioned on an outer edge portion side of the nozzle hole plate is larger than an inside angle that is an intersecting angle of the axis of the nozzle hole and the nozzle hole inner wall surface portion positioned on a center side of the nozzle hole plate, in a cross-section along the long axis of the entry-side open end portion.

14. The fuel injection valve according to claim 9, wherein the nozzle hole is formed such that the long axis of the entry-side open end portion extends toward a center of the valve hole.

15. The fuel injection valve according to claim 9, wherein the nozzle hole is formed such that the entry-side open end portion is adjacent to an edge portion of the valve hole.

16. A fuel injection valve comprising:

a valve body that includes a valve hole;

a valve element provided in the valve body so as to open and close the valve hole; and a nozzle hole plate provided in the valve body so as to cover the valve hole, wherein:

a nozzle hole that extends through in a plate thickness direction is formed in the nozzle hole plate, a flow path cross-section of the nozzle hole being formed such that, in a plan view with respect to the nozzle hole plate, an entry-side open end portion that is positioned on a valve body side is formed in an oval shape having a long axis and a short axis and an exit-side open end portion that is positioned on an opposite side from the valve body side is formed having a long axis and a short axis, and the nozzle hole is formed such that a second angle that is an intersecting angle of opposing nozzle hole inner wall surface portions in a cross-section along the short axes of the entry-side open end portion and exit-side open end portion is greater than a first angle that is an intersecting angle of opposing nozzle hole inner wall surface portions in a cross-section along the long axes of the entry-side open end portion and exit-side open end portion.

* * * * *